United States Patent [19]

Doerr et al.

[11] 3,986,217

[45] Oct. 19, 1976

[54] WHIRLPOOL BATH DEVICE

[76] Inventors: John J. Doerr, 2425 Ramona St., Pinole, Calif. 94564; Jack R. Conser, 56 Belcrest Ave., Daly City, Calif. 94015

[22] Filed: Mar. 7, 1975

[21] Appl. No.: 556,275

Related U.S. Application Data

[63] Continuation of Ser. No. 313,141, Dec. 7, 1972, abandoned.

[52] U.S. Cl. ..... 4/178; 4/180

[51] Int. Cl.[2] ..... A47K 3/10; A47K 3/00

[58] Field of Search ..... 4/178, 180; 128/66

[56] References Cited

UNITED STATES PATENTS

| | | | |
|---|---|---|---|
| 3,067,435 | 12/1962 | Nash | 4/180 |
| 3,287,741 | 11/1966 | Nash | 4/180 |
| 3,297,025 | 1/1967 | Jacuzzi | 4/180 X |
| 3,304,936 | 2/1967 | Kosta | 4/180 X |
| 3,319,266 | 5/1967 | Schneider et al. | 4/180 |
| 3,340,870 | 9/1967 | Steltz et al. | 4/180 X |
| 3,580,247 | 5/1968 | Schneider et al. | 128/66 |

*Primary Examiner*—Stanley N. Gilreath
*Assistant Examiner*—Donald B. Massenberg
*Attorney, Agent, or Firm*—Schapp and Hatch

[57] ABSTRACT

A whirlpool bath device having a valve assembly including a concentric ring and cap for manual control of the water inlet pressure and the flow of air entrained in the water, the cap being spring loaded to afford pressure relief and prevent breakage. The water and entrained air emerge into the tub through a discharge outlet having an adjustable and wear-compensating nozzle provided with a dished flange engageable by the foot of the user for controlling the direction of the output flow through the nozzle.

3 Claims, 5 Drawing Figures

WHIRLPOOL BATH DEVICE

This is a continuation of application Ser. No. 313,141 filed Dec. 7, 1972, now abandoned.

BACKGROUND OF THE INVENTION

The present invention relates to a WHIRLPOOL BATH DEVICE, and more particularly to a device producing and controlling a strong flow of water and entrained air into a bathtub.

Typical prior art hydro massage devices have characteristically lacked means for closely controlling the flow of water through the apparatus as well as the amount of air entrained thereon. Such devices further lack adequate pressure relief devices. Moreover they do not contain means for easily adjusting the direction of the output flow of water with air entrained. These devices are characteristically cumbersome to install, operate, and clean and are relatively complex. In addition, such devices are often constructed so that after usage, water remains in various cavities which tends to cause the unit to become dirty and moldy.

SUMMARY OF THE INVENTION

The general purpose of this invention is to provide a whirlpool bath assembly adapted to be mounted in a bathtub and which avoids the afore-described disadvantages of the prior art. To attain this, the present invention provides a housing having a water inlet with a valve member movable into a valve seat on the water inlet to thereby control the flow of water into the device. The valve member is carried on a hollow valve stem through which air passes to an aspirator device located between the valve stem and the valve head. The valve stem is mounted on a jack nut which in turn is mounted on a concentric ring. The housing is mounted on a tub in such a manner that the concentric ring is arranged through a hole so that it may be reached with ease and may be manually turned to permit axial movement of the valve stem to open or close the valve and thereby control the flow and velocity of water passing through the device. A spring loaded cap is arranged on the collar to control the amount of air which enters through the valve stem and the aspirator head to be entrained on the water flowing into the system.

The water and entrained air pass through a flexible hose to an output nozzle mounted on the tub wall. The output nozzle comprises a dished flange arranged thereon and a swivel member which is mounted in a spherical seat. The swivel member is preferably formed of a self-lubricating plastic such as nylon or Teflon. Compensation for wear is achieved by making the surface of the swivel member somewhat raised as compared to the rest of the spherical surface. The inside of the swivel member (the side of the member directed toward the hose) is notched so that when it is forced into the spherical seat by a screwing down ring, a compressive force is exerted on the inside of the swivel member which tends to take up the slack as the swivel member wears. The direction of the output flow may be controlled by a user of the hydro therapy device by simply adjusting the dished flange on the output nozzle either manually or with his toe.

The flexible hose in the system requires pressure relief means. The pressure relief is afforded through the operation of the spring loaded cap having air passages therethrough. In the event that pressure in the system becomes excessive, the water may pass through the stem of the valve and by virtue of the pressure on the spring loaded cap, pass through the air passages out into the tub.

The device is mounted on a tub to permit exposure only of the concentric ring as well as the spring loaded cap arranged thereon. The dished flange of the nozzle is exposed through a separate hole in the tub. An overflow port is arranged on the tub just beneath the concentric ring and cap arrangement to prevent the level of water from rising up to the ring and cap arrangement. A suction outlet is further arranged on the tub which is connected to a pump which pumps the water back up to the water inlet having the valve seat and valve head arrangement thereon. A standard drain having a shut-off valve and a trap is arranged on the tub and is connected with the overflow outlet to an output drainpipe.

Accordingly an object of the present invention is to provide hydrotherapy means which may be installed, operated, and cleaned with ease.

Another object of the present invention is to provide means to control the flow of water and entrained air thereon in a whirlpool bath device.

A further object of the present invention is to provide means for relieving the pressure in a whirlpool bath apparatus.

Still another object of the present invention is to provide means to control the direction of the output flow of water with entrained air.

Yet another object is to provide nozzle means having a dished flange which is swivel mounted on a spherical seat attached to the end wall of a tub engageable by the foot of the user for ease of manipulation in controlling the direction of the output flow of water with entrained air.

Other objects, advantages and novel features of the present invention will become apparent from the following detailed description of the invention when considered in conjunction with the accompanying drawings.

DESCRIPTION OF THE PREFERRED EMBODIMENTS

Figure 1:
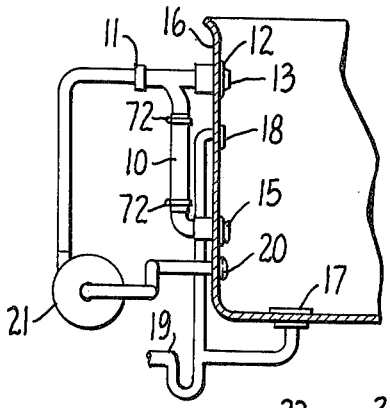
FIG. 1 is a view of the present invention installed in a bathtub.

Referring now to FIG. 1 there is shown an embodiment of the present invention having a water input at 11 and a concentric ring 12 and an air control cap 13 for controlling the flow of air which enters input 11. An adjustable output nozzle assembly generally shown at 15 may be manipulated to control the direction of the discharge of water entrained with air. The apparatus is mounted on a bathtub 16 having a drain 17 and overflow outlet 18 both connected to drainpipe 19 having a trap as shown. The overflow outlet 18 prevents the water level from rising above the level of concentric ring 12 and air control cap 13. A suction strainer 20 is arranged on the tub 16 as shown and a pump 21 pumps strained water through the suction 20 and back to the inlet 11 of the apparatus.

Figure 2:
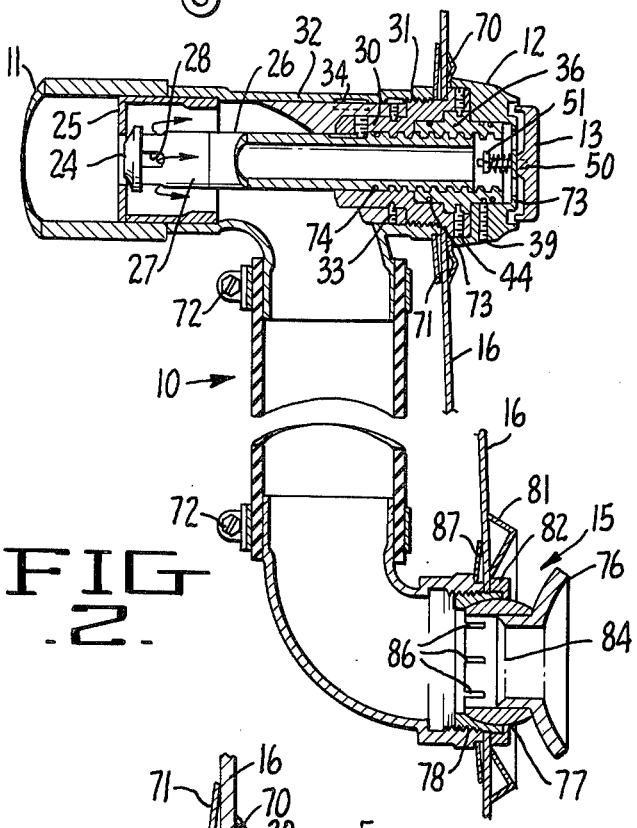
FIG. 2 is a side view of the invention.

As shown in greater detail in FIG. 2 a valve head 24 is operative in conjunction with a valve seat 25 to control the input flow of water. The valve head is mounted on a valve stem 26 having an aspirator head 27 with ports 28. The valve stem is mounted on a valve stem guide 30 which in turn is thread mounted on the apparatus at threads 31 as shown in greater detail in FIG. 4. A jack nut 36 is threaded on the valve stem 26 as shown and set screws 38 and 39 on valve stem guide 30 permit jack nut 36 to rotate but prevent axial movement of the jack nut.

A set screw 41 is arranged on the body member to fit into groove 42 of the valve stem 26 as shown. Rotation of the jack nut 36 causes axial movement of the valve stem 26 either to the right or to the left until the sides of groove 42 abut against set screw 41. A contour bushing 32 having a retainer screw 33 and a slide key 34 is arranged as shown to permit the smooth flow of water with air entrained thereon through the apparatus.

The concentric ring collar 12 is mounted on the jack nut 36 and fastened to it by set screw 44. The ring 12 may be manually rotated to thereby rotate the jack nut 36 and move the valve stem 26 axially either to the right or to the left until set screw 41 abuts against either side of the groove 42. As shown in FIG. 2 the valve stem 26 may be moved axially to the left until the valve head 24 is seated in the valve seat 25 to prevent the input flow of water. Correspondingly the ring 12 may be rotated in the opposite direction to cause jack nut 36 to move the valve stem 26 axially to the right to permit the desired amount of water into the apparatus. The total displacement of the valve stem 26 to the right is limited by the abutment of the set screw 41 against the left side of groove 42. Thus it is seen that the rotation of the ring 12 controls the input flow of water.

Figure 3:
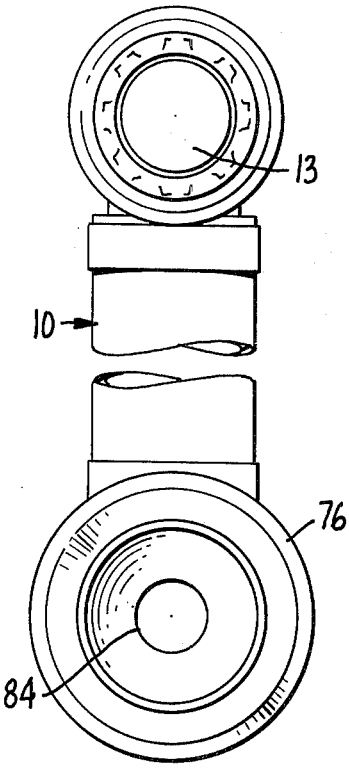
FIG. 3 is a frontal view of the invention.
Figure 4:
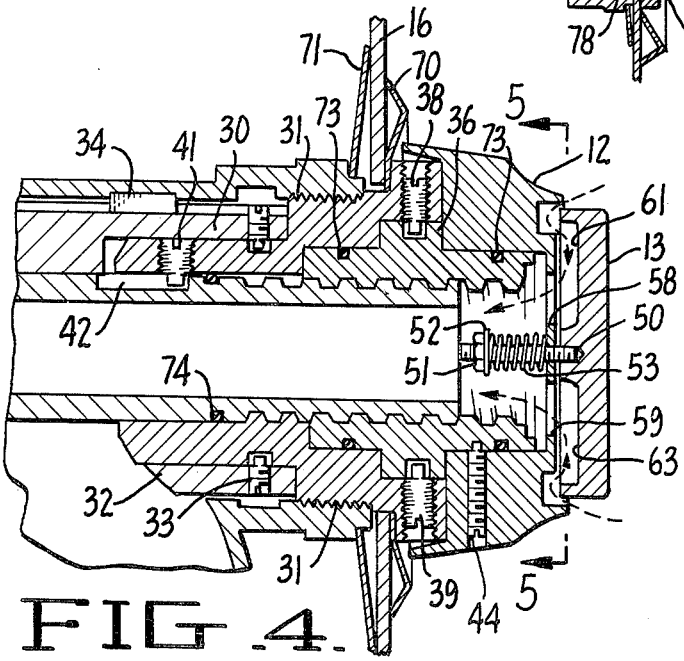
FIG. 4 is a detailed view of a part of FIG. 2 showing in particular the air input control mechanism as well as the pressure relief mechanism.

The cap 13 which is shown in FIGS. 2, 3 and 4 controls the flow of air which enters into the valve stem 26 and through the ports 28 and the aspirator head 27. The cap 13 is bolt mounted by a stud 50 on the shoulder as shown in FIGS. 2 and 4. The stud has a nut 51 and a washer 52 arranged thereon. A spring 53 is arranged between the washer 52 and the ring collar 12 as shown in FIGS. 2 and 4.

Figure 5:
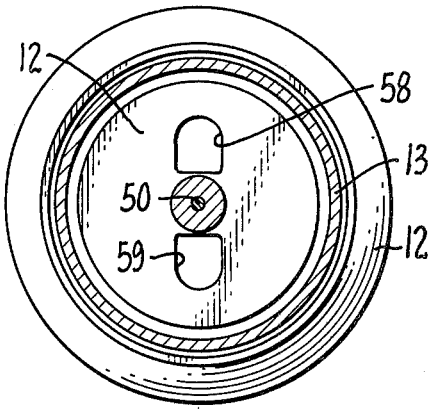
FIG. 5 is a section of FIG. 4 taken in the plane 5 — 5 of FIG. 4.

The ring collar 12 has input ports 58 and 59 as shown in FIG. 5. The cap 13 has air passage grooves 61 and 63 as shown in FIG. 4. When the cap 13 is rotated so that the air passage grooves 61 and 63 directly face the ports 58 and 59 of the ring collar 12, air flows through the grooves 61 and 63 through the ports 58 and 59 into valve stem 26 and out the aspirator head ports 28 to be entrained on the stream of water which passes between the valve head 24 and valve seat 25. The cap 13 may be rotated to adjust the amount of air that flows into the valve stem 26 and is entrained on the flow of water.

The arrangement of the stud 50 with spring 53 mounted thereon serves as a pressure relief device. When the pressure in the housing builds up, in order to avoid rupture of any of the parts, the spring 53 permits the cap 13 to be urged to the right to permit water to flow through the valve stem 26 through the ports 58 and 59 and out into the tub.

An escutcheon 70 is arranged as shown in FIGS. 2 and 4 to abut against the side of tub 16 in conjunction with backplate 71 of the apparatus to fasten it to the tub 16. "O" ring 73 is arranged between the body member 30 and the jack nut 36 and "O" ring 74 is arranged between the body member 30 and the axial tube 26. Furthermore "O" ring 75 is arranged between the ring 12 and the jack nut 36. The "O" rings provide sealing in a manner well-known in the art.

A flexible connector hose 10 is secured to the assembly by clamps 72 as shown in FIGS. 1 and 2. The clamps have worm type screws and are of the type well-known in the art. The hose communicates water entrained with air to the output nozzle assembly generally shown at 15 in FIG. 1.

The nozzle arrangement 15 comprises a dished flange 76 having a swivel member 77 with an outer surface forming a portion of a sphere and slideably mounted on spherical seat 78 as shown in FIG. 2. The spherical seat is thread mounted on the body of the apparatus as shown. An outlet escutcheon 81 and a backplate 87 are arranged as shown to keep the nozzle arrangement 15 mounted on the end wall of the tub 16 as shown. A spherical adapter retainer 82 may be screwed on the outside of spherical seat 78 to urge the swivel member 77 to the left to thereby keep the swivel member mounted in the spherical seat. It further keeps escutcheon 81 in direct abutment with the end wall of tub 16. Compensation for wear is achieved by making the surface of swivel member 77 toward the left side as viewed in FIG. 2 somewhat raised as compared to the rest of the spherical surface. The left side contains notches 86 arranged so that the forcing of the swivel member 77 to the left by the screwing down of ring 82 exerts a compressive force on the left side of swivel member 77. This tends to take up the slack as the member wears. The nozzle arrangement has a hole 84 as shown in FIGS. 2 and 3 for discharge of the water with entrained air. The dished flange 76 may be manipulated either manually or by the toe of the user to adjust the output flow of water with air entrained thereon. The nozzle may be turned to cause the swivel member 77 simply to rotate in the spherical seat 78.

Thus it is seen that the present invention provides a whirlpool bath device to control the flow of water with air entrained thereon in a bathtub. The manual water and air controls are easily accessible to the user. The apparatus provides a pressure relief device to prevent any of the components from rupturing from high pressure. It further provides a nozzle arrangement which may be swivel mounted to easily control the direction of flow of the water with air entrained thereon. Moreover, it is constructed in such a manner so as to avoid water from remaining in the apparatus after usage to thereby prevent the apparatus from becoming dirty and moldy.

Obviously many modifications and variations of the present invention are possible in light of the above teachings. It is therefore to be understood that within the scope of the appended claims the invention may be practiced otherwise than as specifically described.

We claim:

1. A whirlpool bath apparatus, comprising a tub, a pump mounted outside said tub, an intake conduit connecting the intake of said pump with an opening low in said tub, nozzle means opening into said tub and formed for projecting a stream of water thereinto, an output conduit connecting the output of said pump with said nozzle means, air supply means formed for entraining air into water passing through said output conduit and having an air inlet portion adapted to project into said tub through an opening high in a wall of said tub, said air inlet portion being formed with a variable orifice for controlling the quantity of air entrained in the water in said output conduit, and said air inlet portion having resiliently displaceable means for allowing said orifice to open wider in response to back pressure in said output conduit.

2. A whirlpool bath apparatus, comprising a tub, a pump mounted outside said tub, an intake conduit connecting the intake of said pump with an opening low in said tub, nozzle means opening into said tub and formed for projecting a stream of water thereunto, an output conduit connecting the output of said pump with said nozzle means, air supply means formed for entraining air into water passing through said output conduit and having an air inlet portion adapted to project into said tub through an opening high in said tub, said air inlet portion being formed with a variable orifice for controlling the quantity of air entrained in the water in said output conduit, said air inlet portion having resiliently displaceable means for allowing said orifice to open wider in response to back pressure in said output conduit, said air inlet portion comprising a housing providing an air inlet opening, an air control member supported by said housing for rotating movement with respect thereto for adjustably covering and uncovering said air inlet opening to control the quantity of air admitted therethrough, and spring means in the connection between said air control member and said housing formed to permit said air control member to move away from said air inlet opening in said housing in response to back pressure in said output conduit and to return said air control member to its adjusted position relative to said housing when said back pressure is relieved.

3. In a whirlpool bath apparatus having a pump mounted outside a tub and connected thereto by pump intake and output conduits, a water valve having a seat adapted for positioning across the output conduit and a valve member movable toward and away from said seat for controlling the rate of flow of water pumped through the output conduit, a rotatable water control handle positioned within the tub and having a stem carrying said valve member and threadably connected to a mounting on the tub for moving said valve member toward and away from said seat upon rotation of said water control handle, said stem being hollow to provide an air passage from the interior of the tub to said output conduit, said valve member being enlarged with respect to said stem to provide a reduced pressure area immediately downstream of said valve member, said stem being formed with an opening therethrough at said low pressure area for aspirating air through said stem, an air control member of said stem in covering relation to the end thereof in the tub, said air control member and said last named end of said stem having alignable apertures therein, said air control member being adjustably movable with respect to said stem for selective alignment and non-alignment of said apertures to control the amount of air admitted to said stem, and said air control member having an axially extending stud slidable in said end of said stem in the tub, enlargement on the distal end of said stud, and a spring compressed between said enlargement and said stem whereby said air control member is returnably displaced away from said stem by back pressure in the latter.

* * * * *